US009402465B1

(12) United States Patent
LaForge

(10) Patent No.: US 9,402,465 B1
(45) Date of Patent: Aug. 2, 2016

(54) SHAVING BRUSH WITH VENTED HOLDER

(71) Applicant: Paul Edward LaForge, Skiatook, OK (US)

(72) Inventor: Paul Edward LaForge, Skiatook, OK (US)

( * ) Notice: Subject to any disclaimer, the term of this patent is extended or adjusted under 35 U.S.C. 154(b) by 0 days.

(21) Appl. No.: 14/301,595

(22) Filed: Jun. 11, 2014

(51) Int. Cl.
*A46B 15/00* (2006.01)

(52) U.S. Cl.
CPC ..... *A46B 15/0091* (2013.01)

(58) Field of Classification Search
CPC . A45D 2200/155; A45D 33/16; A45D 27/04; A45D 27/02; A45D 27/00; A45D 27/46; A45D 27/48; A46B 2200/1033
USPC ..... 15/184, 247; 132/290, 289
See application file for complete search history.

(56) References Cited

U.S. PATENT DOCUMENTS 1,188,443 A 6/1916 Gutman
1,213,352 A * 1/1917 Grady ..... A45D 27/22 132/290
1,298,633 A 4/1919 Alland
1,458,408 A * 6/1923 Hawtin ..... A46B 15/00 15/143.1
1,571,556 A * 2/1926 Nyhagen ..... A45D 27/04 132/289
2,958,329 A 11/1960 Almgren
4,144,967 A 3/1979 Craven et al.
4,998,545 A * 3/1991 Hiromura ..... A45D 27/22 132/289
5,485,649 A * 1/1996 Miceli ..... A46B 9/10 15/144.4

* cited by examiner

*Primary Examiner* — Monica Carter
*Assistant Examiner* — Stephanie Berry
(74) *Attorney, Agent, or Firm* — Molly D. McKay

(57) ABSTRACT

A combination shaving brush and hollow vented holder for the brush. The holder is provided with a female threaded end and an opposite non-threaded end. The brush has male threads on the handle. The brush handle enters the holder via the non-threaded end and the male threads engage the female threaded end to secure the brush within the holder with the bristles of the brush suspended centrally within the holder where they can air dry. A vented cap snaps onto the second end of the holder to protect the bristles of the brush during transport and also serving as a base for resting the holder on a surface. The brush is removed from the holder via the threaded first end without disturbing the bristles of the brush by rotating the brush in the same direction as when securing to the holder to disengage the male threads from the female threads.

1 Claim, 3 Drawing Sheets

SHAVING BRUSH WITH VENTED HOLDER

BACKGROUND OF THE INVENTION

1. Field of the Invention

The present invention relates to a shaving brush and a pass-through vented holder for the brush that allows the wet brush to be stored or transported while allowing it to dry suspended within the holder in such a manner that the bristles of the brush are protected and not disturbed.

2. Description of the Related Art

Generally, after a shaving brush is used, it is either inverted in a shaving cup or suspended from a holder and allowed to dry. In this way, the bristles of the brush remain approximately in their normal configuration and are not bent as they dry. The bristles are best positioned with the bristles facing downward and being suspended as the brush dries.

The present invention allows for the brush to be securely suspended within the holder with the bristles facing down, while requiring only a minimal footprint. Also, when a shaving brush is wet after being used and then must immediately be packed for transport, the brush is often placed in a plastic bag or in a similar container such that it cannot dry and such that the wet bristles are pressed out of shape by the bag or container.

The present invention addresses this transport problem by providing a pass-through vented holder for securely holding a wet shaving brush centrally within the holder. The holder is provided with an end cap for transport to protect the bristles as they dry within the holder and can also serve as a base for the holder to rest upon. The holder allows a shaving brush to be transported while still wet, allows the brush to dry within the holder and provides a container to hold a wet shaving brush suspended in the holder with the bristles facing downward as they dry.

SUMMARY OF THE INVENTION

The present invention is a combination shaving brush and hollow vented holder for the brush. The holder is provided with two opposite open ends: a smaller diameter first end which is provided with female threads internally and a larger second end that is non-threaded. The brush is provided with male threads on the handle which engage female threads provided on a first end of the vented holder to hold the brush with the bristles of the brush suspended centrally within the vented holder. The holder is provided with a plurality of vent openings in the wall of the holder to allow air to pass through the wall to reach the bristles of the brush, allowing the bristles to air dry while secured within the holder.

To secure the brush within the holder, the brush is inserted handle first into the holder through an opposite second non-threaded end of the holder. The handle of the brush passes through the holder until the male threads of the handle engage the female threads on the first end of the holder. The brush is then rotated to secure the brush to the holder. A vented cap snaps onto the second end of the holder to protect the bristles of the brush during transport and also to serve as a base for resting the holder and brush on a surface. When the holder and brush are resting on the vented cap, this allows the bristles to dry with the handle facing upward out of the threaded first end of the holder and holding the downward-facing bristles suspended within the holder.

To remove the brush from the holder, the brush is again rotated in the same direction as when it was first placed in the holder. This allows the brush to be removed via the threaded first end of the holder. Removal of the brush from the threaded first end allows it to be removed from the holder without disturbing the bristles of the brush and without turning them backward as might occur if it were attempted to remove the brush from the second end of the holder through which the brush entered the holder.

DETAILED DESCRIPTION OF THE PREFERRED EMBODIMENT

Figure 1:
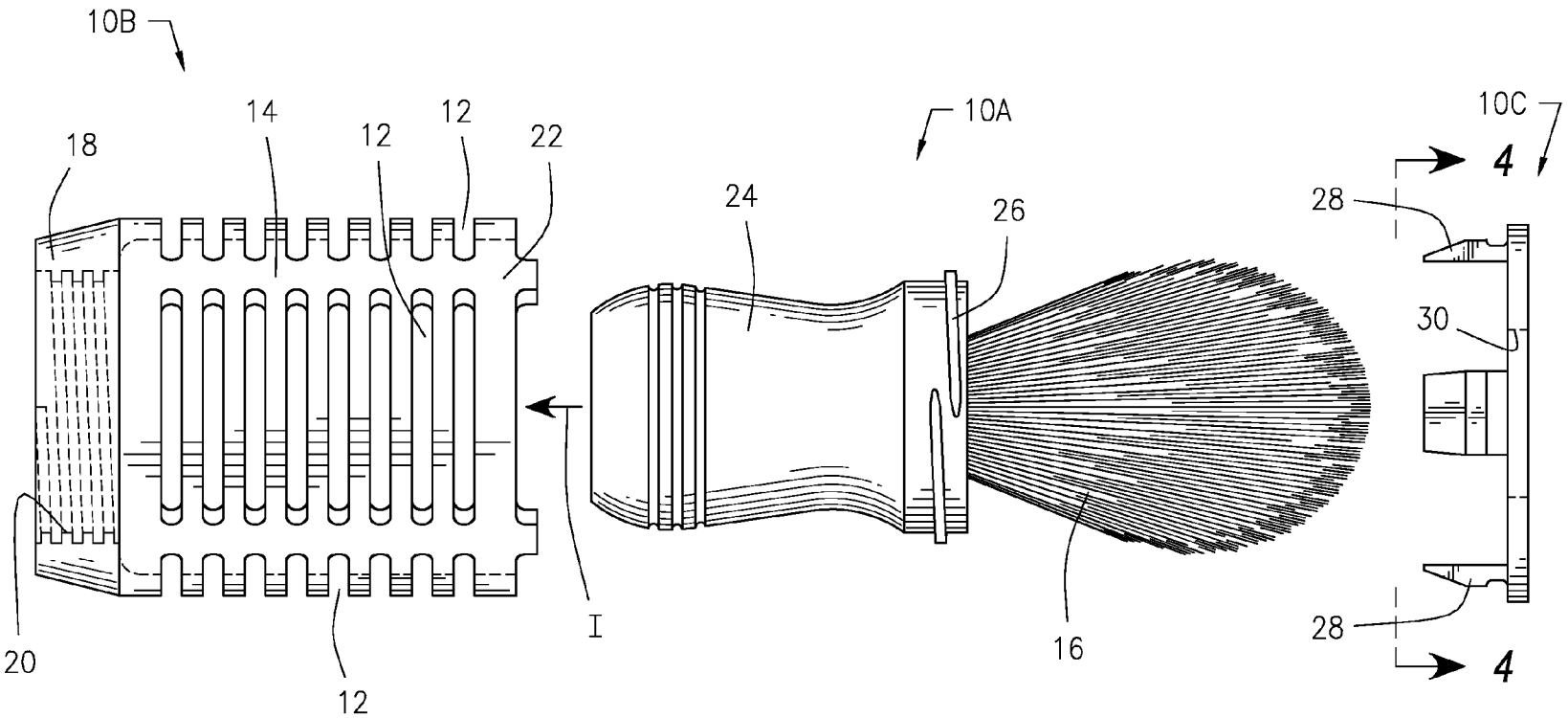
FIG. 1 is an exploded view of the shaving brush and vented holder of the present invention.

Referring now to the drawings and initially to FIG. 1, there is illustrated a shaving brush 10A, vented holder 10B and vented cap 10C that are constructed in accordance with a preferred embodiment of the present invention.

The holder 10B is hollow and is provided with a plurality of vent openings 12 extending through the wall 14 of the holder 10B to allow air to pass through the wall 14 to reach bristles 16 of the brush 10A, allowing the bristles 16 to air dry while secured within the holder 10B. The holder 10B is provided with two opposite open ends: a smaller diameter first end 18 which is provided with female threads 20 internally and a larger second non-threaded end 22.

Figure 2:
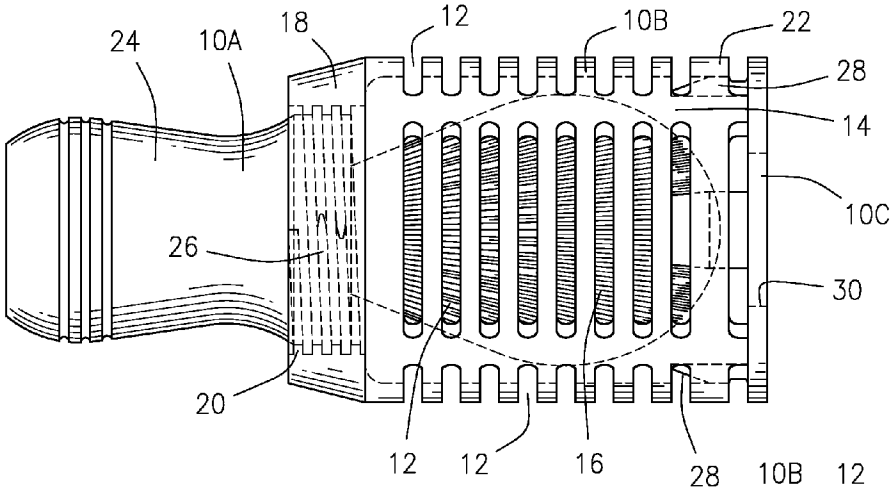
FIG. 2 is the shaving brush and vented holder of FIG. 1 shown as they would appear in use.
Figure 5:
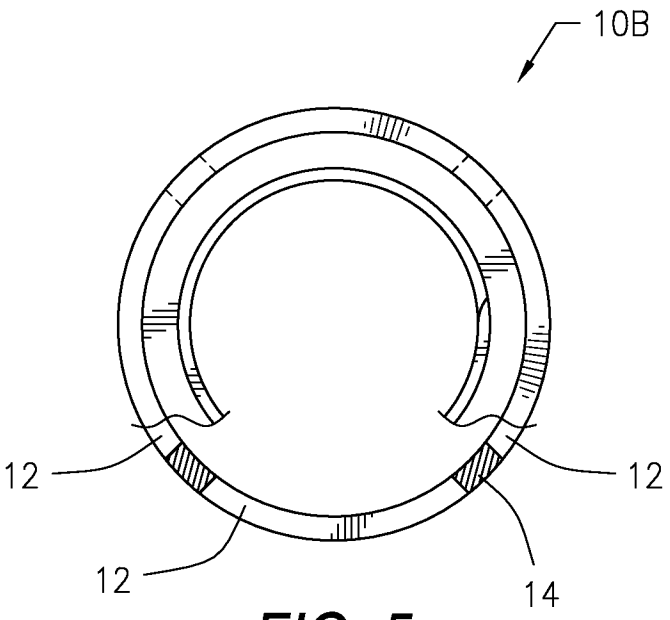
FIG. 5 is a top plan view of the holder taken along line 5-5 of FIG. 3.

The brush 10A has a handle 24 provided on an opposite end from the bristles 16. The handle 24 is provided with male threads 26 which engage the female threads 20 of the first end 18 of the holder 10B to hold the brush 10A so that bristles 16 are suspended centrally within the holder 10B, as illustrated in FIG. 2. The male threads 26 are best seen in FIG. 5.

As shown in FIG. 1 by Arrow I, to secure the brush 10A within the holder 10B, the brush 10A is inserted handle-first into the holder 10B through the second non-threaded end of the holder 22. The handle 24 of the brush 10A passes through the holder 10B until the male threads 26 on the handle 24 come into contact with the female threads 20 of the first end 18 of the holder 10B. The brush 10A is then rotated to engage the male threads 26 with the female threads 20 to secure the brush 10A to the holder 10B.

Figure 4:
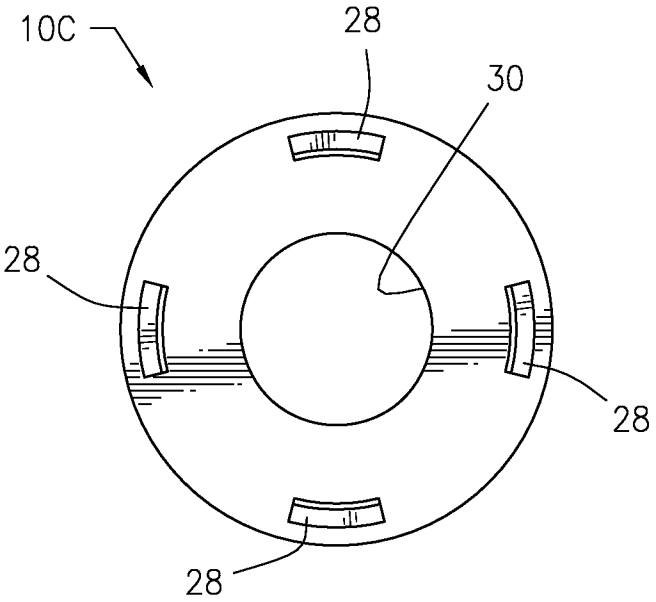
FIG. 4 is a top plan view of the cap taken along line 4-4 of FIG. 1.

The vented cap 10C snaps onto the non-threaded second end 22 of the holder 10B to protect the bristles 16 of the brush 10A during transport. The cap 10C is provided with detents 28 that engage the non-threaded second end 22 of the holder 10B to removably secure the cap 10C to the non-threaded second end 22. The detents can be best seen in FIGS. 1 and 4. FIG. 4 shows the central vent opening provided in the cap 10C.

The cap 10C is flat so that is also serves as a base for resting the holder 10B and brush 10A on a surface. When the holder 10B and brush 10A are resting on the vented cap 10C, the bristles 16 are allowed to dry with the handle 24 facing upward out of the threaded first end 18 of the holder 10B and with the handle 24 holding the bristles 16 so that they are suspended facing downward within the holder 10B.

Figure 3:
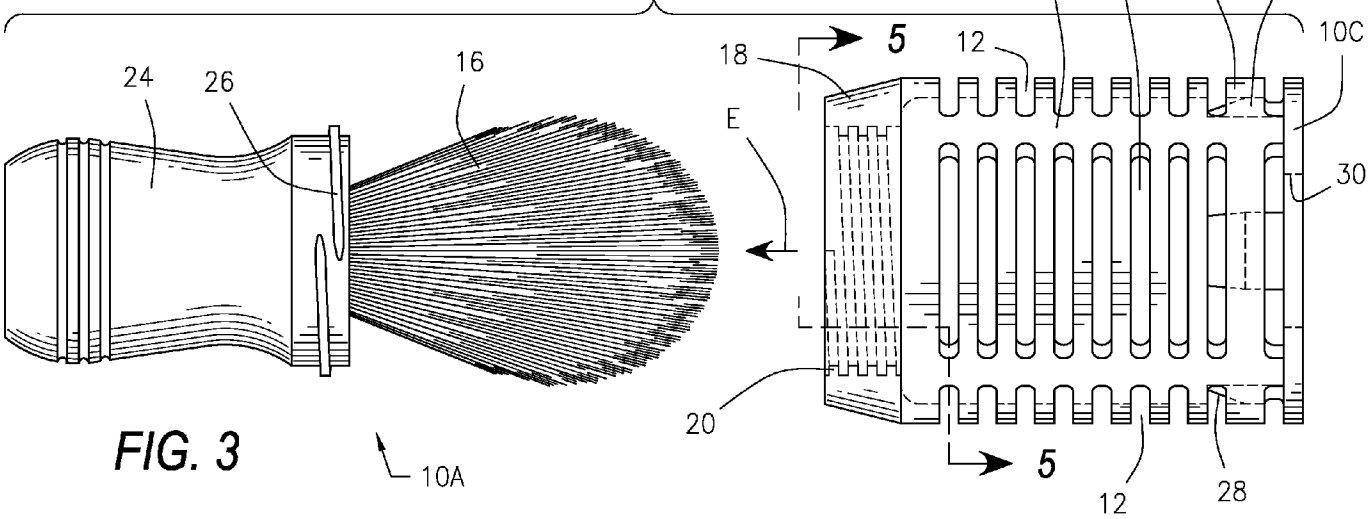
FIG. 3 is the shaving brush and vented holder of FIGS. 1 and 2 showing the brush being removed from the vented holder.

As illustrated in FIG. 3, to remove the brush 10A from the holder 10B, the brush 10A is again rotated in the same direction as when it was first secured in the holder 10B. This allows the male threads 26 of the brush 10A to disengage from the female threads 20 on the first end 18 of the holder 10B which allows the brush 10A to be removed via the threaded first end 18 of the holder 10B, as shown by Arrow E. This allows the brush 10A to be removed from the holder 10B without disturbing the bristles 16 of the brush 10A and without turning the bristles 16 backward as might occur if it were attempted to remove the brush 10A from the second end 22 of the holder 10B through which the brush 10A originally entered the holder 10B.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method for employing a combination shaving brush and hollow vented holder for the brush comprising:

inserting a wet shaving brush handle-first into a first end of a hollow vented holder so that bristles of the brush do not protrude through concentric circumferential ventilation openings provided around the elongated vented holder, continuing to push the brush handle-first into the holder until male threads on a handle of the shaving brush come into contact with female threads provided on an opposite second open end of the holder, rotating the brush sufficiently to allow the male threads on the handle of the brush to engage the female threads on the second end of the vented holder to removably secure the brush within the vented holder, attaching a removable protective travel cap to the first end of the holder by pushing the cap onto the first end of the holder so that tabs provided on the protective travel cap insert and secure by friction fit into the first end of the holder, removing the protective travel cap from the vented holder, rotating the brush in the same direction as previously rotated to removably secure the handle of the brush to the second end of the holder until the male threads on the handle of the brush disengage from the female threads of the second end of the holder, and removing the brush from the holder via the second end of the holder so that bristles of the brush remain protected within the holder wall until the brush is completely removed from the holder.

* * * * *